US006561932B2

(12) United States Patent
Morrow et al.

(10) Patent No.: US 6,561,932 B2
(45) Date of Patent: May 13, 2003

(54) LACROSSE STICK HEAD

(75) Inventors: David Morrow, Farmington Hills, MI (US); Jesse Hubbard, Troy, MI (US)

(73) Assignee: Warrior Lacrosse, Inc., Warren, MI (US)

( * ) Notice: Subject to any disclaimer, the term of this patent is extended or adjusted under 35 U.S.C. 154(b) by 0 days.

(21) Appl. No.: 09/862,012

(22) Filed: May 21, 2001

(65) Prior Publication Data

US 2002/0173388 A1 Nov. 21, 2002

(51) Int. Cl.[7] ..... A63B 65/12
(52) U.S. Cl. ..... 473/513
(58) Field of Search ..... 473/513; D21/724

(56) References Cited

U.S. PATENT DOCUMENTS

| | | | | |
|---|---|---|---|---|
| 346,751 | A | | 8/1886 | Hillman |
| 364,596 | A | | 6/1887 | Luce |
| 891,813 | A | | 6/1908 | Ceel |
| 1,459,389 | A | | 6/1923 | Brown |
| 1,877,820 | A | | 9/1932 | Costello |
| 2,039,138 | A | | 4/1936 | Auer |
| 2,142,527 | A | * | 1/1939 | Pool |
| 2,508,519 | A | | 5/1950 | Jay |
| 2,596,894 | A | | 5/1952 | Frisch |
| 3,086,777 | A | | 4/1963 | Lacoste |
| 3,306,960 | A | | 2/1967 | Weissman et al. |
| 3,473,806 | A | | 10/1969 | Patterson |
| 3,507,495 | A | | 4/1970 | Tucker et al. |
| 3,591,178 | A | | 7/1971 | Milligan et al. |
| 3,644,168 | A | | 2/1972 | Bonk et al. |
| 3,702,702 | A | | 11/1972 | Hoult |
| 3,788,941 | A | | 1/1974 | Kupits |
| 3,822,062 | A | | 7/1974 | Tucker et al. |
| D236,737 | S | | 9/1975 | Brine |
| 3,905,088 | A | | 9/1975 | Tucker et al. |
| 3,910,578 | A | | 10/1975 | Brine, Jr. |
| 3,934,876 | A | | 1/1976 | Haddad |
| 4,022,477 | A | | 5/1977 | Pool |
| 4,034,984 | A | | 7/1977 | Crawford et al. |
| 4,037,841 | A | | 7/1977 | Lewis, Jr. |
| 4,049,273 | A | | 9/1977 | Pool |

(List continued on next page.)

FOREIGN PATENT DOCUMENTS

| | | |
|---|---|---|
| CA | 1273662 | 9/1990 |

OTHER PUBLICATIONS

Brine Lacrosse Catalog, 1998 Edition, p. 19, Published in United States.

Brine Lacrosse Catalog, 1999 Edition, p. 7, Published in United States.

STX Lacrosse Catalog, 1999–2000 Edition, p. 19, Published in United States.

STX Lacrosse Catalog 2000, Lacrosse Head.

STX Lacrosse Catalog 2000, Heads.

BRINE Catalog 2000; Lacrosse Head.

*Primary Examiner*—Paul T. Sewell
*Assistant Examiner*—M. Chambers
(74) *Attorney, Agent, or Firm*—Artz & Artz, PC

(57) ABSTRACT

A lacrosse head for use with a lacrosse handle includes a frame element including an arcuate wall, a scoop opposing the arcuate wall, and a pair of opposing sidewalls. The sidewalls generally extend between the arcuate wall and the scoop. The frame element has a socket extending rearwardly therefrom for receipt of a handle therein. The lacrosse head has a plurality of net attachment means formed therein for attachment of lacrosse net thereto. The lacrosse head has a pocket area defined by a lower portion of the arcuate wall, the scoop, and a lower portion of each of the pair of opposing sidewalls. The lacrosse head also has a catching area defined by an upper portion of the arcuate wall, the scoop, and an upper portion of each of the pair of opposing sidewalls. The catching area of the head is larger than the pocket area.

57 Claims, 3 Drawing Sheets

U.S. PATENT DOCUMENTS

| | | | | |
|---|---|---|---|---|
| 4,097,046 | A | | 6/1978 | Friant |
| D248,679 | S | | 7/1978 | Rule |
| 4,138,111 | A | | 2/1979 | Rule |
| 4,153,251 | A | | 5/1979 | Pond |
| D252,167 | S | | 6/1979 | Ahlenfeld et al. |
| 4,206,918 | A | | 6/1980 | Lewis, Jr. |
| D257,909 | S | | 1/1981 | Brine |
| 4,270,756 | A | | 6/1981 | Ahlenfeld et al. |
| D263,248 | S | | 3/1982 | Brine, Jr. |
| D263,249 | S | | 3/1982 | Rule |
| D265,845 | S | | 8/1982 | Brine, Jr. et al. |
| 4,351,528 | A | | 9/1982 | Duplin |
| 4,358,117 | A | | 11/1982 | Deutsch |
| RE31,419 | E | | 10/1983 | Frolow |
| D273,601 | S | * | 4/1984 | Lewis, Jr. et al. |
| 4,460,178 | A | | 7/1984 | Ulman |
| D277,691 | S | | 2/1985 | Rule |
| D286,666 | S | | 11/1986 | Brine, Jr. |
| D286,803 | S | | 11/1986 | Brine, Jr. |
| 4,657,260 | A | | 4/1987 | Brine, Jr. |
| 4,739,994 | A | | 4/1988 | Lewis, Jr. |
| D297,963 | S | | 10/1988 | Tucker et al. |
| 4,861,042 | A | | 8/1989 | Trettin |
| 4,938,480 | A | | 7/1990 | Lods |
| 4,940,243 | A | | 7/1990 | Tucker et al. |
| 5,007,652 | A | | 4/1991 | Tucker et al. |
| D318,509 | S | | 7/1991 | Naumburg, Jr. |
| 5,035,434 | A | | 7/1991 | Taylor et al. |
| 5,037,112 | A | | 8/1991 | Brine, III et al. |
| 5,048,843 | A | | 9/1991 | Dorfi et al. |
| 5,054,790 | A | | 10/1991 | Brine, III et al. |
| 5,067,726 | A | | 11/1991 | Brine, III et al. |
| 5,080,372 | A | | 1/1992 | Brine, III et al. |
| 5,082,290 | A | | 1/1992 | Tucker et al. |
| D331,086 | S | | 11/1992 | Brine, III et al. |
| 5,174,580 | A | | 12/1992 | Pratt |
| 5,178,397 | A | | 1/1993 | Brine, Jr. |
| 5,237,703 | A | | 8/1993 | Brine et al. |
| 5,269,532 | A | | 12/1993 | Tucker et al. |
| 5,290,039 | A | | 3/1994 | Cornelio |
| 5,494,297 | A | * | 2/1996 | MacNeil |
| 5,566,947 | A | * | 10/1996 | Tucker et al. |
| 5,568,925 | A | | 10/1996 | Morrow et al. |
| D376,183 | S | | 12/1996 | Morrow et al. |
| 5,651,744 | A | | 7/1997 | Millon et al. |
| 5,935,026 | A | | 8/1999 | Dill et al. |
| 6,066,056 | A | * | 5/2000 | Morrow |

* cited by examiner

LACROSSE STICK HEAD

TECHNICAL FIELD

The present invention relates generally to a lacrosse head and, more particularly, to a lacrosse head for a lacrosse stick that can more accurately locate a lacrosse ball in the pocket of the head and therefore provide improved ball control, retention, and playability.

BACKGROUND OF THE INVENTION

Current lacrosse heads are typically constructed of an open frame having a base with a concave interior surface that defines a ball rest, a pair of sidewalls that diverge from the base, and a lip or scoop that interconnects the sidewalls remotely of the base. Openings or other attachment structures are carried by the frame for securing a lacrosse net around the back side of the frame, leaving the opposing front side of the frame open for receiving lacrosse balls. A throat or other structure exteriorly projects from the base of the frame and has a socket formed therein for attachment to a handle. The handle and throat attachment define a handle/head axis, which typically, although not necessarily forms, the central axis and/or an axis of lateral symmetry of the head. All or at least a major portion of the front side of the head is conventionally disposed in a plane parallel to the handle/head axis.

More recently, however, lacrosse heads have been commercially introduced that have a portion of the sidewall disposed below the handle/head axis. For example, U.S. Pat. No. 5,568,925 to Warrior Lacrosse discloses one embodiment for a scooped lacrosse head where the sidewall curves downward below and away from the handle/head axis and then curves upward back toward the axis. The scooped lacrosse head possesses numerous advantages over conventional lacrosse head constructions in which the front side of the frame is disposed essentially or entirely in a plane that lies parallel to the upper surface of the lacrosse stick. The curved sidewalls of the lacrosse head disclosed in the '925 patent naturally channel the lacrosse ball into the "sweet spot" or pocket of the net. Further, the pocket of the net will typically have a deeper construction than with conventional heads, such that the lacrosse ball lies a further distance below the upper rims of the sidewalls. Moreover, the arched scoop-like construction of the head, and the consequent scooped construction of the net attached to the head, provides a greater distance for the ball to travel in the net during a throwing motion, thereby improving both ball speed and "feel."

Other lacrosse heads have been commercially introduced that abruptly lower the sidewall of the lacrosse head such that the upper rims of the sidewalls lie at or below the centerline of the lacrosse stick. Purported examples of these commercial lacrosse heads are disclosed in U.S. Pat. Nos. 5,651,549 and 5,935,026. According to these patents, lacrosse heads of this configuration can provide a lacrosse stick that has a weight distribution between the stick head and handle such that the head will naturally return to a neutral or open position. Also, according to these patents, this configuration can provide improved player feel, which facilitates cradling, throwing and receiving of a ball. Furthermore, the offset head's natural rotation to an open position as disclosed in these patents minimizes the chance of a player unintentionally receiving a thrown ball with the wrong side of a lacrosse head.

While these head configurations, which vary from the traditional configuration, provide different characteristics with regard to playability and feel, they do not address the concern of maintaining a lacrosse ball in the head once received in the netting. Attempts have been made in this regard to provide structure for a lacrosse head that helps maintain a lacrosse ball in the pocket and help to resist it from being checked from the lacrosse head, but these structures have caused other problems. For example, U.S. Pat. No. 6,066,056 discloses a plurality of ball retaining ridges protruding from the interior surface of the sidewalls. Each ridge has an underside extending generally downwardly and outwardly toward the ball pocket and serves to direct and retain the ball within the pocket. However, the extensions of these ridges from the sidewalls into the pocket also decreases the effective catching area of the lacrosse head. Additionally, U.S. Pat. No. 5,048,843 discloses a lacrosse head having a base portion that is recessed or rounded in a direction opposite the open frame to assist in retaining a lacrosse ball therein. The '843 patent also discloses a recessed padded ball stop to assist in the same purpose. Other commercial lacrosse heads have pinched in the upper portions of the sidewall such that the sidewalls angle outwardly therefrom. This configuration does provide some ball retention attributes, but it decreases the catching area of the head.

None of these prior lacrosse heads, however, provide any structure to narrow the pocket of the head and thereby keep the lacrosse ball, while in the head, in line with the center of the stick without narrowing the effective catching area of the head. Rather, in an effort to provide a wide catching area, these heads allow for a significant amount of side-to-side movement of the ball between the bottom portions of the sidewalls.

SUMMARY OF THE PRESENT INVENTION

Accordingly, it is an object of the present invention to provide a lacrosse head that is configured with a narrow pocket to keep the ball in line with the centerline of the stick.

It is a related object of the present invention to provide a lacrosse head with the bottom portions of opposing sidewalls being narrower than the top portions of the opposing sidewalls.

It is a further object of the present invention to provide a lacrosse head that prevents wear of the stringing when the ball resides in the lacrosse head.

It is another object of the present invention to provide a lacrosse head that provides a decreased pocket area for better ball retention without decreasing the size of the catching area.

It is still another object of the present invention to provide a lacrosse head that assists in preventing the lacrosse ball from being dislodged from the head during use.

It is still a further object of the present invention to provide a lacrosse head with a throat configuration that is stronger and lighter than prior lacrosse heads.

In accordance with the above and other objects of the present invention, a lacrosse head for a lacrosse stick is provided. The lacrosse head has an open frame having a rearward base, a lip or scoop opposing the base, and a pair of sidewalls extending between the base and the lip. The lacrosse head has a throat portion projecting rearwardly from the open frame for receipt of a lacrosse stick element therein so as to define a head/handle axis projecting forwardly of the throat portion. The open frame has a plurality of net securing structures carried thereon for securing a lacrosse net along a back side of the frame, leaving an opposing front side of the frame open for receiving a lacrosse ball. Each of the pair of sidewalls has a bottom portion and a top portion. Each of the sidewalls curves generally outward as it extends upward from the bottom portion to the top portion, such that the top portions of the sidewalls are located a further distance apart than the bottom portions of the sidewalls.

In accordance with another object of the present invention, the bottom portion of each sidewall has a recessed shoulder that is stepped back with respect to each sidewall surface. The plurality of net securing structures are disposed in the shoulder.

These and other features and advantages of the present invention will become apparent from the following description of the invention, when viewed in accordance with the accompanying drawings and appended claims.

DETAILED DESCRIPTION OF THE PREFERRED EMBODIMENTS

Figure 1:
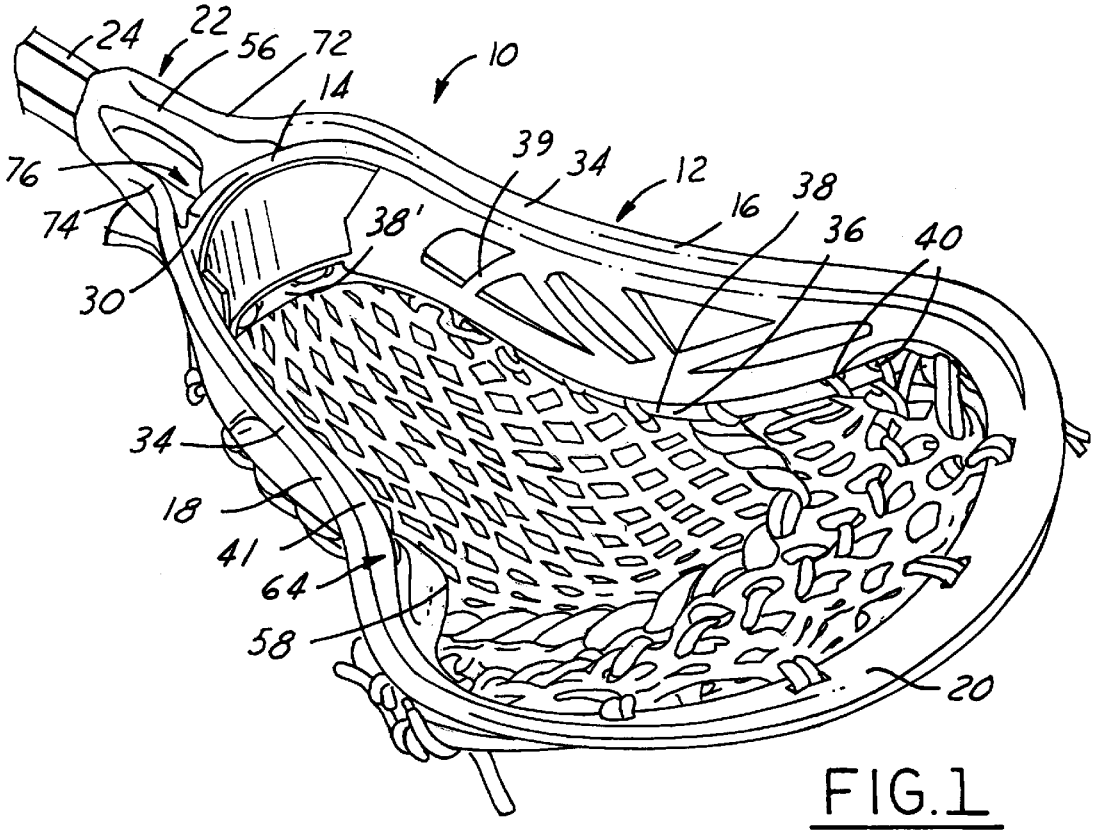
FIG. 1 is a top perspective view of a lacrosse head and attached handle in accordance with a preferred embodiment of the present invention.
Figure 2:
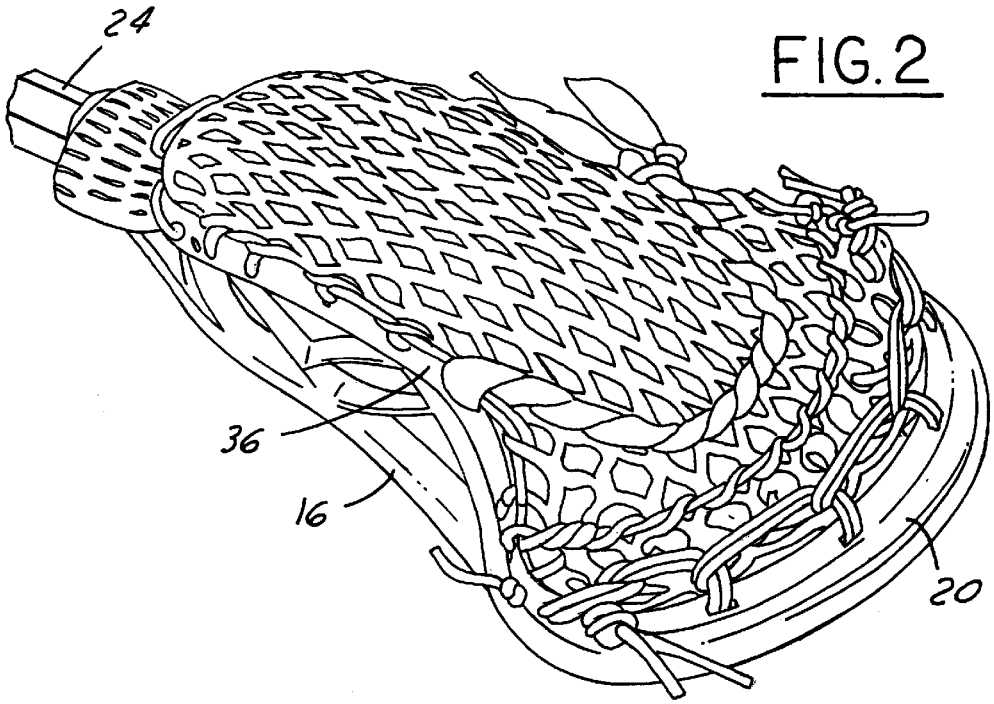
FIG. 2 is a bottom view of a lacrosse head and attached handle in accordance with a preferred embodiment of the present invention.
Figure 4:
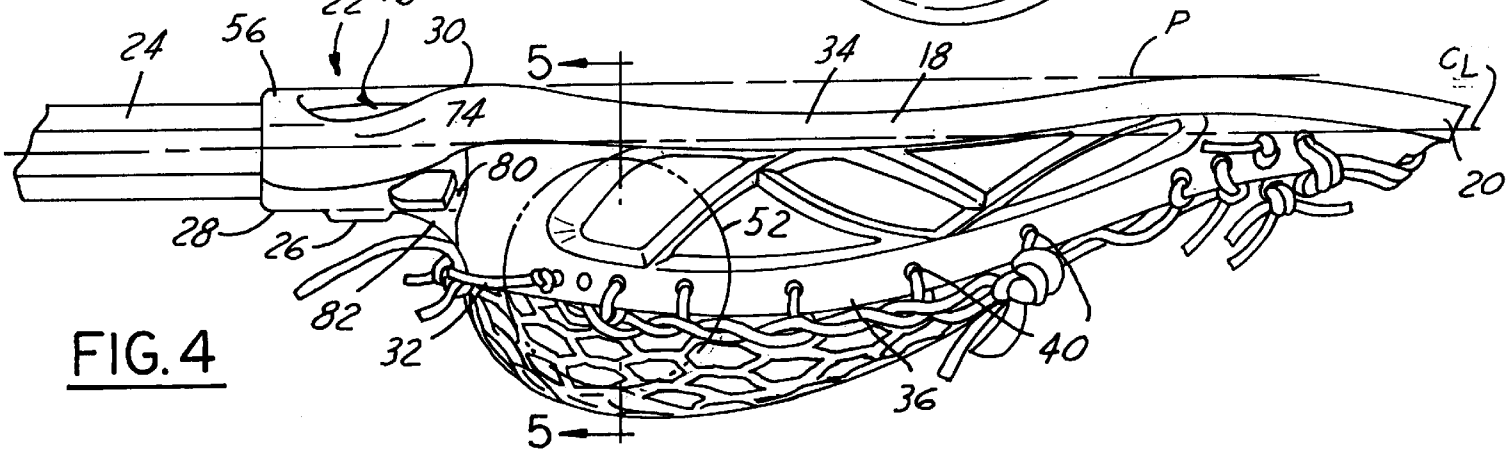
FIG. 4 is a side view of a lacrosse head and attached handle in accordance with a preferred embodiment of the present invention.

Referring now to FIGS. 1 and 2, which illustrate a lacrosse head 10 in accordance with the present invention. The lacrosse head 10 has a frame element 12, which includes a base or arcuate wall 14, a pair of opposing sidewalls 16, 18, and a scoop or lip 20 connecting the pair of opposing sidewalls 16, 18 opposite the base 14. The lacrosse head 10 has a throat or socket 22 that extends generally rearwardly from the frame element 12 for attachment of a stick handle or element 24 therein. The stick handle 24 is preferably secured in the socket 22 by a securing means, such as a screw or the like, which is inserted into a fixation hole 26 formed in the socket 22. The fixation hole 26 is preferably formed in a lower surface 28 of the socket 22 (FIG. 4). However, it should be understood that the fixation hole 26 can be formed in any portion of the socket 22.

The base 14 has an upper rim 30 and a lower rim 32. Additionally, the sidewalls 16, 18 each have an upper rim 34 and a lower rim 36. The lower rims 36 of each of the sidewalls 16, 18 are preferably recessed with respect to the sidewalls 16, 18 to form a recessed channel 38. The recessed channel 38 is recessed outwardly with respect to an inner surface 39, 41 of each sidewall 16, 18. Similarly, the lower rim 32 of the base 14 is preferably recessed with respect to the base 14 to form a recessed channel 38'. The recessed channels 38, 38' preferably have a plurality of net securing structures 40 located therein. The net securing structures 40 are preferably stringing holes that are formed through the head to allow attachment of the netting. However, it will be understood that a variety of other net securing structures may be utilized. By locating the net securing means 40 in the recessed channels 38, 38', undue wear on the netting is prevented when the ball is received into or shot or passed from the lacrosse head 10. In addition to protecting the net from abrasion, the recessed channels 38, 38' greatly facilitate ball control during play. Further, the recessed channels 38, 38' allow the lacrosse ball to rest more deeply in the pocket of the net and throat of the head than in the case of prior art constructions.

The recessed channel 38 in each sidewall preferably has a top surface 42, which extends outwardly from and generally perpendicular to each of the sidewalls 16, 18 and an outer surface 44, which extends generally downwardly from and generally perpendicularly to the top surface 42 towards the lower rim 32. This provides a generally stepped back configuration. The recessed channel 38 is preferably integrally formed in the lower portion of the sidewalls 16, 18. In addition to protecting the stringing, the recessed channel 38 also acts as a seat for the ball when it is in the netting. The recessed channel 38 thus enhances the ability of the player to retain and secure the ball in the lacrosse head 10 while also facilitating play of the ball from the head 10. It will be understood that instead of two surfaces 42, 44, the recessed channel 38 could be configured as a single curved surface, an outwardly slanting surface or other similar shape.

Figure 5:
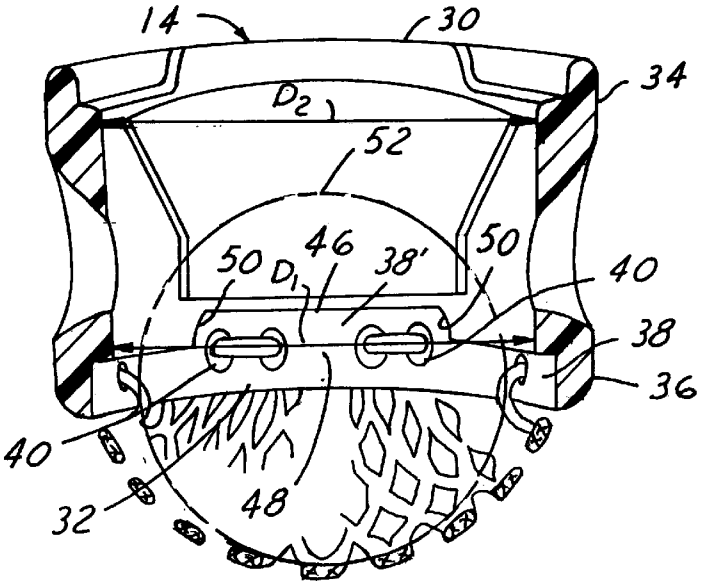
FIG. 5 is a cross-sectional view of a lacrosse head along the line 5–5 in FIG. 4.

As shown best in FIGS. 1 and 5, the recessed channel 38' has a top surface 46 that extends outwardly and generally perpendicular from the base 14 and a rear surface 48 that extends downwardly and generally perpendicularly from the top surface 46 to the lower rim 32. The recessed channel 38' has a pair of side portions 50 that extend generally between the top surface 46 and the rear surface 48 and preferably connect at a lower end with the channel 38 form in either sidewall 16, 18. This also provides a generally stepped back configuration. The enlarged recessed channel 38' at the base 14 allows a portion of the lacrosse ball 52 to rest therein, when the ball is carried in a typical pocket formed adjacent the base 14. The recessed channel 38' thus also enhances the ability of a player to retain and secure the ball in the lacrosse head 10. It will be understood that the recessed channel 38 in the sidewalls 16, 18 can be the same size as the recessed channel 38' in the base 14. Also, instead of a variety of different surfaces 46, 48, 50, the recessed channel 38' could be configured in a variety of different ways, including curved, angled, or slanted. The base 14 also preferably has a foam resilient padding or ball stop 54 applied to its inner surface to cushion the impact of the ball when in contact with the base 14.

Figure 3:
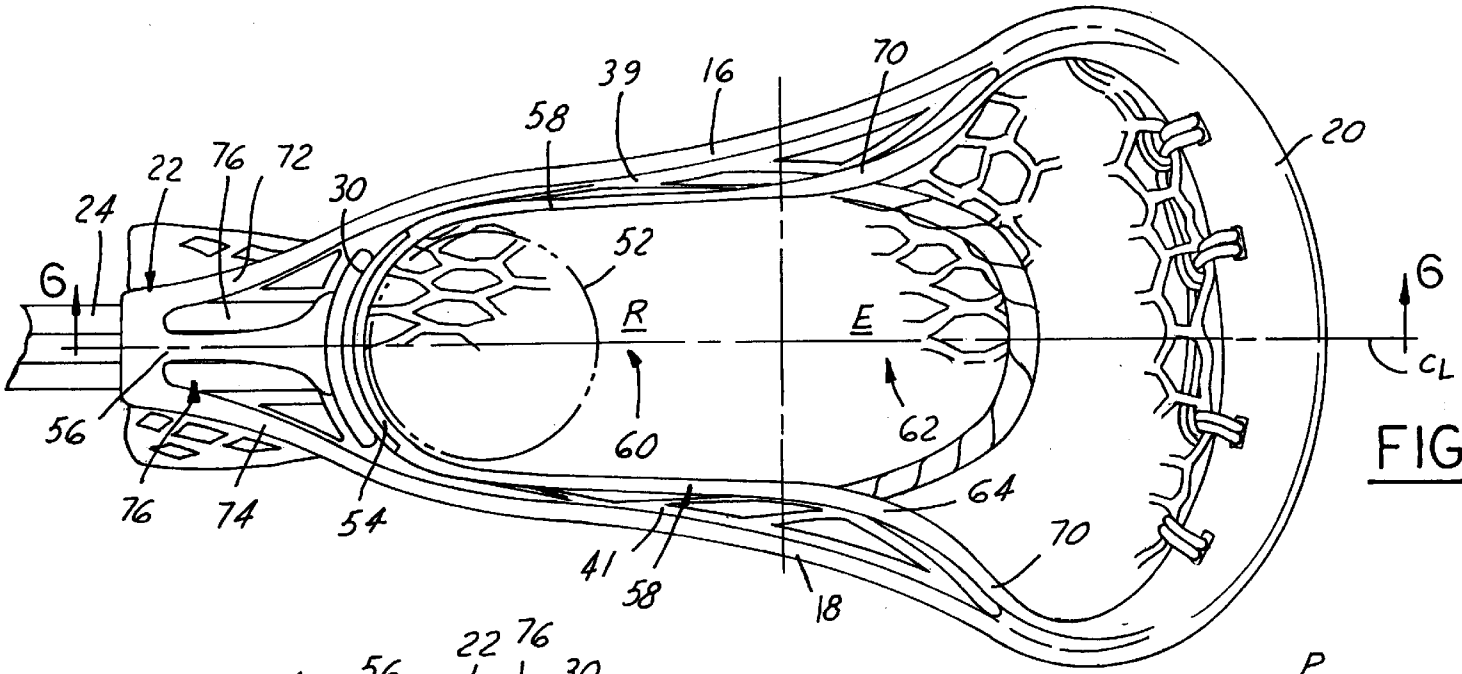
FIG. 3 is top view of a lacrosse head and attached handle with a ball positioned in the head in accordance with a preferred embodiment of the present invention.
Figure 6:
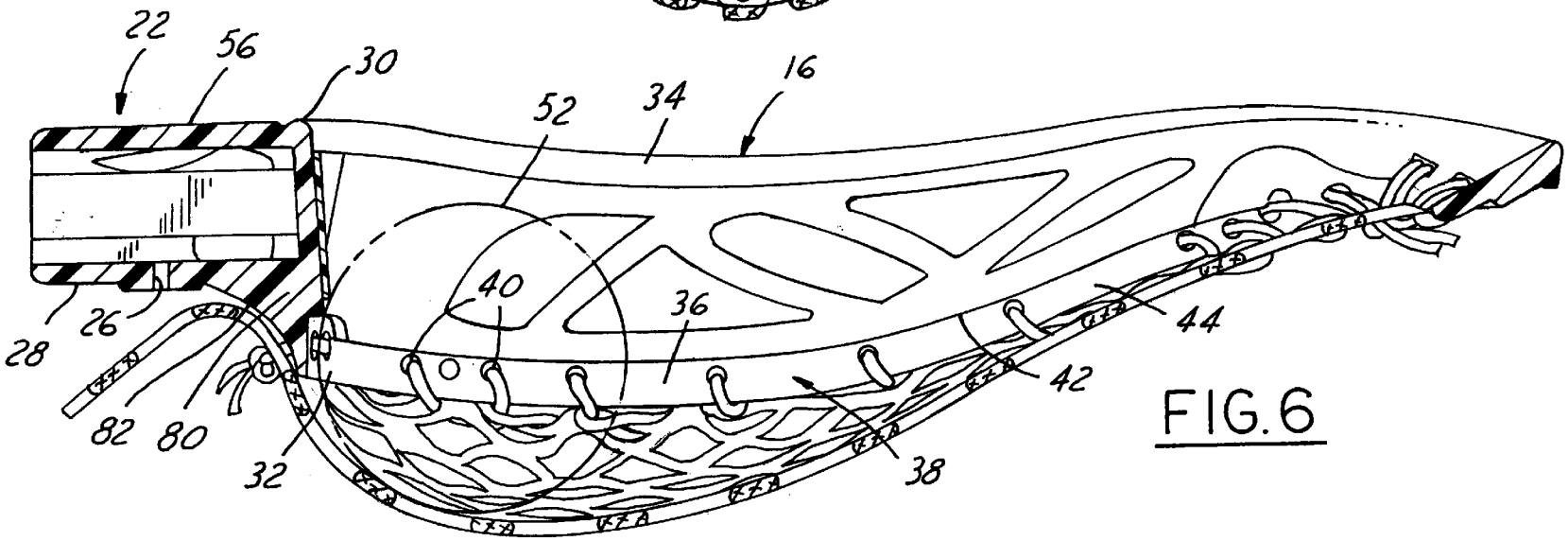
FIG. 6 is a cross-sectional view of a lacrosse head along the line 6–6 in FIG. 3.

Referring now to FIGS. 3, 4, and 6, which illustrate the relationship of the sidewalls 16, 18 to the socket 22. The upper rim 34 of each of the sidewalls 16, 18 is preferably lowered with respect to a plane P defined by an upper surface 56 of the socket 22. The upper rim 34 of each of the sidewalls 16, 18 is preferably lowered to a distance that is below the upper surface 56 of the socket 22, but remains above a centerline $C_L$ of the lacrosse stick. The upper rim 34 of each of the sidewalls 16, 18 is preferably lowered downwardly in a gradually curving fashion. As is known, the upper rim 34 of each of the sidewalls 16, 18 may be lowered in other manners, such as by a sharp drop-off, or by a step or gradual slanting. It is preferred that the upper rims 34, once lowered to a specified distance remain lowered. Alternatively, the upper rims 34 of each sidewall 16, 18 can curve back or otherwise extend upward toward the plane P.

As shown, each sidewall 16, 18 is preferably configured such that it extends generally outwardly or flares from the lower rim 36 to the upper rim 38. This flaring creates a "pinched" configuration of the sidewalls. The degree to which each sidewall 16, 18 tapers or flares may be entirely uniform from the base 14 to the scoop 20, may progressively increase, may progressively decrease or take on a variety of other configurations. It is preferred, however, that across the length of each sidewall 16, 18 each upper rim 34 is located further outwardly from the corresponding lower rim 36 of each sidewall 16, 18. Additionally, the inner surface 39, 41 of each sidewall 16, 18 located immediately above the recessed channel 38 is also disposed inwardly with respect to each corresponding upper rim 34. Each inner surface 39, 41 is preferably configured to extend in a generally continuous fashion from the top surface 42 of the recessed channel 38 to the upper rim 34. In the preferred embodiment, this configuration is generally curved or arcuate. However, it will be understood that the inner surface 39, 41 of each sidewall may alternatively be sloped, inclined, convex, stepped, or any combination of the above. Moreover, different portions of a single sidewall can take on a variety of different shapes.

Put another way, the distance ($d_1$) between the opposing lower rims 36 of each sidewall 16, 18 is shorter than the distance ($d_2$) between the opposing upper rims 34 of each sidewall 16, 18. However, as discussed in detail below, the difference between $d_2$ and $d_1$ preferably varies as each sidewall 16, 18 extends from the base 14 to the scoop 20.

As shown, each sidewall 16, 18 and the area between each sidewall is broadly divisible into a rear portion 60 adjacent the base 14 and a forward portion 62 adjacent the scoop 20. The division of the sidewalls 16, 18 preferably occurs generally at about the mid-point of the frame element 12. It will be understood that the division of the sidewalls 16, 18 can occur at a variety of other locations.

In the rear portion 60 of the head, the upper rims 34 are flared outwardly a smaller distance with respect to the lower rims 36 than the upper rims 34 are flared outwardly with respect to the lower rims 36 in the forward portion. This also helps create the "pinched" configuration. In other words, the upper rims 34 in the forward portion 62 are flared outwardly more than the upper rims 34 in the rear portion 60. Put another way, the variation in distances $d_2$ versus $d_1$ is greater in the forward section 62 than in the rear section 60 and generally increases from the base 14 to the scoop 20.

The catching area of the lacrosse head 10 is the area defined by the upper rims 34 of the sidewalls 16, 18, the upper rim 30 of the base 14, and the upper rim of the scoop 20. The catching area is functionally the portion of the head 10 where the lacrosse ball can be received and maintained within the head 10. The catching area is generally defined by the upper portion of the open frame 12. The pocket area of the lacrosse head 10 is the area defined by the lower rims 36 of the sidewalls 16, 18, the lower rim 32 of the base 14, and the scoop 20. The pocket area is functionally the portion of the head where the ball can be maintained in the head and in contact with the netting. However, a player typically carries the lacrosse ball during possession thereof in the rear section 60. In accordance with the preferred embodiment, the catching area is larger than the pocket area. It should be understood that the ball can be carried anywhere in the head, but is best retained in the rear section 60 where the distance between the lower rims 36 of the sidewalls 16, 18 is narrow.

In the rear section 60, the lower rims 36 of each of the sidewalls 16, 18 extend forwardly from the base 14 such that the lower rims 36 are generally parallel to one another. Alternatively, the lower rims 36 may extend from the base 14 in a slightly diverging manner. Similarly, the lower portions 58 of the inner surfaces 39, 41 of each sidewall are preferably configured generally parallel to one another in the rear portion 60. This configuration of the lower rims 36 maintains the area of the netting in the rear portion 60 relatively narrow with respect to the diameter of the lacrosse ball. The upper rims 34 of each of the sidewalls 16, 18 extend forwardly from the base 14 in a more diverging manner than the lower rims 36. The distance between the lower rims 36 of each of the sidewalls 16, 18 is substantially constant in the rear section 60. Similarly, the lower portion 58 of each sidewall inner surface 39, 41 has a distance therebetween which is substantially constant and preferably only slightly larger than the size of a lacrosse ball. The distance between the upper rims 34 preferably slightly diverges to define a catching area that is larger than the pocket area defined by the lower rims 36. Thus, the rear portion 60 is configured to define a narrow pocket area which will facilitate retention of the ball therein and maximize control because of the minimal width between the lower rims 36 and the lower portion 58 of the inner surfaces of the sidewalls. While the figures illustrate the rear portion 60 as extending generally forward to the mid-point of the head, it will be understood that this is only illustrative. The rear portion 60 can end short of the mid-point or extend beyond the midpoint depending upon the configuration of the sidewalls and the size of the pocket area.

By this configuration, the middle or center of the lacrosse ball 52 is maintained generally along the centerline $C_L$ of the stick in the rear portion 60 because there is relatively little room for movement or play between the lower rims 36 to allow the lacrosse ball to move. This results in more accurate shots and passes as the lacrosse ball will be generally located along the same line as the path of travel of the lacrosse stick.

The forward portion 62 generally is defined by the location where the pocket or ball retaining area significantly increases. In the forward portion 62, the upper rims 34 of the sidewalls 16, 18 curve outwardly with respect to the centerline $C_L$ of the stick and also outwardly with respect to the lower rims 36 to form a bend 64 in each sidewall 16, 18. The bend 64 allows the catching area in the forward portion 62 to be increased significantly. This configuration creates a "filleted" appearance to the forward portion 62. The distance between the lower rims 36 is preferably still less than the distance between the upper rims 34 in the forward portion 62. Moreover, the sidewalls 14, 16 extend generally outwardly from the lower rim 36 to the upper rim 34, as discussed above. The recessed channel 38 is preferably located adjacent the lower rim 36 of each sidewall 14, 16 in the forward portion 62. The configuration of the sidewalls 14, 16 in the forward portion 62 as compared to the rear portion 60 allows a lacrosse ball to be easily caught through the open frame 12 and more readily maintained in the narrower rear portion 60. The pocket area is preferably significantly decreased with respect to current heads without decreasing or affecting the catching area.

As best shown in FIG. 3, the sidewalls 16, 18 each preferably have a stiffening ridge 70 formed on a respective inner surface 39, 41 thereof. The ridge 70 is preferably located at the lower portion 58 of the sidewalls 14, 16. The ridge 70 provides additional strength to support the sidewalls 16, 18 and also helps deflect more balls into the netting. It will be understood that the ridge 70 can be located anywhere along the inner surface 39, 41 of each sidewall 16, 18. If, however, the ridge 70 is located closer towards the upper rims 34, it will decrease the width between the inner surfaces 39, 41 of the sidewalls 16, 18.

Additionally, the socket 22 preferably has a bridge portion 72, 74 located on either side of the handle 24. Each of the bridge portions 72, 74 is integrally molded to a respective sidewall 16, 18 in order to strengthen the connection of the socket 22 to the frame element 12. This connection through the inclusion of the bridge portions 72, 74 minimizes throat breakage and decreases the amount of deflection that would be present in the head during shooting and passing. This configuration will provide a head with more consistent passing and shooting capabilities. Moreover, because of the inclusion of the bridge portions 72, 74, the socket 22 preferably has a plurality of openings 76 formed at least partially in the upper surface 56 thereof. The openings 76 allow the head 10 to be manufactured with less material, thereby reducing material costs without comprising strength.

The lower surface 28 of the socket 22 preferably has a sinusoidal bridge 80 extending between the socket 22 and the frame element 12. The bridge 80 also minimizes throat breakage that can occur due to a lacrosse head having an offset configuration as well as due to lighter weight heads. The sinusoidal bridge 80 minimizes any forward or rearward flex in the head to keep it stiff without adding additional material. The lower surface 28 of the socket 22 also preferably has a finger notch 82 formed therein. The finger notch 82 is intended to receive a player's finger therein and thus prevent the player's hand from sliding above the arcuate wall 14 of the head 10.

Having now fully described the invention, it will be apparent to one of ordinary skill in the art that many changes and modifications can be made thereto without departing from the spirit or scope of the invention as set forth herein.

What is claimed is:

1. A lacrosse head comprising:

a base;

a scoop;

a throat area extending rearwardly from said base for accommodating a lacrosse handle therein;

an axis defined by a centerline of said throat area that extends generally between said scoop and said base and does not intersect said sidewalls; and a pair of spaced apart sidewalls, which diverge from said base toward said scoop and define a ball receiving area, wherein said sidewalls each have an upper portion and a lower portion with said sidewalls being progressively outwardly inclined substantially from said base towards said scoop whereby said upper portion is disposed further outwardly with respect to said axis than said lower portion.

2. The lacrosse head of claim 1 wherein said sidewalls are uniformly progressively outwardly inclined.

3. The lacrosse head of claim 1 wherein said upper portion defines a ball receiving area and said lower portion includes string retaining means and defines a ball possession area.

4. The lacrosse head of claim 3 wherein said ball receiving area is progressively larger with respect to said ball retaining area from said base towards said scoop.

5. The lacrosse head of claim 3 wherein the head includes a forward section and a rear section and wherein said ball possession area comprises a substantially uniform width throughout said rear section and said ball receiving area comprises a progressively increasing width from said base towards said scoop.

6. The lacrosse head of claim 3 wherein said string retaining means are located in a recessed channel formed in said lower portion.

7. A lacrosse head for attachment to a lacrosse handle, comprising:

an open frame having a rearward arcuate wall, a pair of sidewalls that extend generally forwardly from said rearward arcuate wall, and a scoop that connects said pair of sidewalls opposite said rearward arcuate wall;

a throat projecting rearwardly from said open frame and having a socket for receipt of the lacrosse handle therein;

a plurality of net attachment structures associated with said open frame allowing a net to be secured to said open frame;

each of said pair of sidewalls having a lower rim and an upper rim, and wherein at at least one location along said open frame a first distance defined by the distance between said upper rims of said sidewalls is greater than a second distance defined by the distance between said lower rims of said sidewalls;

wherein said sidewalk define a rear portion and a forward portion and wherein said lower rims of said sidewalls are generally parellel to one another in said rear poriton.

8. The lacrosse head of claim 7, wherein each of said pair of sidewalls has an inner surface and an outer surface and at least a portion of said lower rim of each of said sidewalls is recessed outwardly with respect to said inner surface of said sidewalls.

9. The lacrosse head of claim 7, wherein at least one of said plurality of attachment structures is formed adjacent said recessed lower rim.

10. The lacrosse head of the claim 7, wherein said first distance is greater than said second distance along the entire length of each of said pair of sidewalls.

11. The lacrosse head of claim 10, wherein each of said sidewalls has an inner surface that is generally convex in shape from said lower rim to said upper rim.

12. The lacrosse head of claim 10, wherein each of said sidewalls has an inner surface that is generally inclined from said lower rim to said upper rim.

13. The lacrosse head of claim 10, further comprising:

a stiffening rib formed on an inner surface of each of said pair of sidewalls.

14. The lacrosse head of claim 7, wherein said first distance progressively increase from said rearward arcuate wall to said scoop.

15. The lacrosse head of claim 7, wherein each of said sidewalls has a bend formed therein which divides the head into a forward portion and a rearward portion, wherein the difference between said first distance and said second distance in said rearward portion is less than the difference between said first distance and said second distance in said forward portion.

16. The lacrosse head of claim 7, further comprising:

a finger notch formed in an underside of said throat for accommodating a user's finger.

17. A lacrosse head for attachment to a lacrosse handle, comprising:

a frame element having an arcuate wall, a scoop opposing said arcuate wall, and a pair of sidewalls that generally diverge from said arcuate wall and said scoop;

a socket extending rearwardly from said frame element for receipt of a handle therein to define a head/handle axis;

a pocket area defined by a lower portion of said arcuate wall and a lower portion of each of said pair of opposing sidewalls; and a catching area defined by an upper portion of said arcuate wall, an upper portion of each of said pair of opposing sidewalls, and including any inwardly extending protrusions;

whereby said catching area is substantially larger than said pocket area to increase the ball retention characteristics of the head without decreasing the ability to catch the ball.

18. The lacrosse head of claim 17, wherein said lower portion of at least one sidewall has a recessed portion formed therein to assist in retaining a lacrosse ball in said pocket area.

19. The lacrosse head of claim 18, wherein said recessed portion has a plurality of net attachment means formed therein.

20. The lacrosse head of claim 19, wherein said recessed portion has a stepped back configuration.

21. The lacrosse head of claim 19, wherein said recessed portion is configured as an inclined surface.

22. The lacrosse head of claim 19, wherein said recessed portion has a curved configuration.

23. The lacrosse head of claim 17, wherein said sidewalls each have an upper rim that is lowered with respect to a plane defined by an upper surface of said socket.

24. The lacrosse head of claim 17, wherein said sidewalls each have an upper rim and a lower rim and wherein the distance between said upper rims is greater than the distance between said lower rims from said arcuate wall to said scoop.

25. The lacrosse head of claim 24, wherein said distance between said upper rims progressively increases with respect to said distance between said lower rims from said arcuate wall to said scoop.

26. The lacrosse head of claim 17, wherein said sidewalls are progressively outwardly inclined from said arcuate wall to said scoop.

27. The lacrosse head of claim 17, wherein said pocket area has a rear section and a forward section.

28. The lacrosse head of claim 27, wherein said rear section of said pocket area comprises a substantially uniform width between a lower rim of each of said sidewalls.

29. The lacrosse head of claim 17, wherein said socket has a finger notch formed on an underside thereof.

30. The lacrosse head of claim 17, further comprising:

a stiffening ridge formed on an inner surface of each sidewall.

31. A lacrosse stick head for attachment to a lacrosse stick, comprising:

a frame element defining an open area for receiving a lacrosse ball including:

a rear arcuate wall;

a scoop located opposite said rear arcuate wall; and a pair of opposing sidewalls that generally diverge from said rear arcuate wall to said scoop, said pair of opposing sidewalls each having an inner surface with an upper section and a lower section, said pair of sidewalls each being broadly divisible into a rear portion and a forward portion;

wherein at least a portion of each of said lower sections in said rear portion are disposed further inwardly than a corresponding portion of said upper sections.

32. The lacrosse stick head of claim 31 wherein said pair of opposing sidewalls are progressively outwardly inclined from said rear arcuate wall to said scoop.

33. The lacrosse stick head of claim 31 wherein said pair of opposing sidewalls are leaning outwardly from said lower section to said upper section.

34. The lacrosse stick head of claim 31 wherein lower section includes an integrally formed recessed channel.

35. The lacrosse stick head of claim 34 wherein said integrally formed recessed channel has an attachment mechanism for attaching a netting to the frame element formed therein.

36. The lacrosse stick head of claim 31 wherein at least a portion of said lower section in said forward portion has an outward radius of curvature that is greater than an outward radius of curvature of said upper section in said forward portion.

37. The lacrosse stick of claim 34, wherein said recessed channel is stepped back from said inner surfaces of said sidewalls.

38. The lacrosse stick head of claim 31 wherein said rear section comprises an open area between said opposing sidewalls having a width, said width starting at said rear arcuate wall and being slightly larger than the width of a lacrosse ball, said width increasing in size at a distance from said rear arcuate wall which is significantly greater than the width of a lacrosse ball.

39. The lacrosse stick head of claim 38 wherein said width between said upper portion of said sidewalls progressively increases from said base to said scoop.

40. The lacrosse head of claim 31, further comprising:

a stiffening ridge formed on said inner surface of each of said pair of opposing sidewalls.

41. The lacrosse head of claim 40, wherein said stiffening ridge is formed in said lower section.

42. The lacrosse head comprising:

a base;

a scoop;

a throat area extending rearwardly from said base for accommodating a lacrosse handle therein;

a pair of spaced apart sidewalls extending between said scoop and said base defining a ball receiving area, at least one of said pair of sidewalls having a recessed channel formed in a lower portion of an inner side thereof to assist in retaining a lacrosse ball therein.

43. The lacrosse head of claim 42, wherein said sidewalls are progressively outwardly inclined from said base towards said scoop.

44. A lacrosse head for attachment to a lacrosse handle comprising:

a base;

a scoop;

a throat area extending rearwardly from said base for accommodating the lacrosse handle therein, and a pair of spaced apart sidewalls extending between said scoop and said base, said sidewalls having an upper portion and a lower portion, said upper portion defining a ball receiving area and said lower portion defining a ball possession area;

wherein the head includes a forward portion and a rear portion and wherein said ball possession area has a substantially uniform width throughout said rear section and said ball receiving area comprises a progressively increasing width from said base towards said scoop.

45. The lacrosse head of claim 44, wherein said substantially uniform width throughout said rear section is slightly larger than a lacrosse ball.

46. The lacrosse head of claim 44, wherein said sidewalls are uniformly progressively outwardly inclined from said base to said scoop.

47. The lacrosse head of claim 44, wherein said sidewalls include a recessed channel formed in said lower portion to assist in retaining a lacrosse ball therein.

48. A lacrosse head for attachment to a lacrosse stick, comprising:

a frame element defining an open area for receiving a lacrosse ball including:

a rear arcuate wall;

a scoop located opposite said rear arcuate wall;

a pair of opposing sidewalls extending from said rear arcuate wall to said scoop, said pair of sidewalk having an upper section and a lower section; and wherein each of said sidewalk have an outward bend formed therein such that at least a portion of said lower section has a smaller radius of curvature than a corresponding portion of said upper section.

49. A lacrosse head comprising:

a base;

a scoop;

a throat area extending rearwardly from said base for accommodating a lacrosse handle therein;

a pair of spaced apart sidewalls that extend between a first end connected to said base and a second end connected to said scoop;

a handle axis defined by a centerline of a lacrosse stick intended to be attached to the head;

each of said sidewalls having a lower portion, which is disposed outwardly from said handle axis with respect to a middle portion of said sidewalls such that said middle portion can overlie and contact a lacrosse ball to assist in retaining it within the head and wherein each of said sidewall has an upper portion, which is disposed outwardly from said handle axis with respect to said middle portion of said sidewalls.

50. The lacrosse head of claim 49, wherein a plurality of stringing holes are formed in said lower portion.

51. The lacrosse bead of claim 49, wherein the head has a throat portion and a forward portion and wherein said lower portion of each of said sidewalls is disposed outwardly with respect to said middle portion throughout said throat portion.

52. The lacrosse head of claim 49, wherein said lower portion is sloped outwardly with respect to said middle portion.

53. The lacrosse head of claim 49, wherein said upper portion is curved outwardly with respect to said middle portion.

54. The lacrosse head of claim 42, wherein a plurality of string holes are formed in said recessed channel.

55. The lacrosse head of claim 54, wherein said recessed channel includes a surface that curves outwardly from said inner side of said sidewall.

56. The lacrosse head of claim 54, wherein said recessed channel includes a surface that slants outwardly from said inner side of said sidewall.

57. The lacrosse head of claim 44, wherein said sidewalls generally diverge from said base to said scoop.

* * * * *

UNITED STATES PATENT AND TRADEMARK OFFICE

CERTIFICATE OF CORRECTION

PATENT NO. : 6,561,932 B2
DATED : May 13, 2003
INVENTOR(S) : David Morrow and Jesse Hubbard It is certified that error appears in the above-identified patent and that said Letters Patent is hereby corrected as shown below:

Column 8,
Line 15, should read as follows:
-- wherein said sidewall define a rear portion and a forward --

Column 11,
Line 8, should read as follows:
-- wherein each of said sidewall have an outward bend --

Signed and Sealed this

Fifth Day of October, 2004

JON W. DUDAS
*Director of the United States Patent and Trademark Office*